US007938179B2

(12) United States Patent
Bane et al.

(10) Patent No.: US 7,938,179 B2
(45) **Date of Patent: *May 10, 2011**

(54) METHOD OF USING A CHARGED CHAMBER PRESSURE TRANSMITTER FOR SUBTERRANEAN TOOLS

(75) Inventors: Darren E. Bane, Broken Arrow, OK (US); Steven L. Jennings, Friendswood, TX (US); David Z Anderson, Glenpool, OK (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 32 days.

This patent is subject to a terminal disclaimer.

(21) Appl. No.: 12/683,723

(22) Filed: Jan. 7, 2010

(65) Prior Publication Data

US 2010/0108312 A1 May 6, 2010

Related U.S. Application Data

(63) Continuation of application No. 11/642,426, filed on Dec. 20, 2006, now Pat. No. 7,665,518.

(51) Int. Cl.
*E21B 47/00* (2006.01)

(52) U.S. Cl. ..... 166/250.01; 166/66; 166/373; 166/386

(58) Field of Classification Search ..... 166/250.01, 166/66, 373, 386, 319; 73/714; 251/12–63.6
See application file for complete search history.

(56) References Cited

U.S. PATENT DOCUMENTS

| | | | | |
|---|---|---|---|---|
| 2,780,290 | A | 2/1957 | Natho | |
| 4,790,378 | A | 12/1988 | Montgomery et al. | |
| 6,109,351 | A | 8/2000 | Beall | |
| 6,116,268 | A | 9/2000 | Johnson | |
| 7,665,518 | B2 * | 2/2010 | Bane et al. | 166/250.01 |
| 2001/0013412 | A1 | 8/2001 | Tubel | |
| 2003/0168219 | A1 | 9/2003 | Sloan | |

(Continued)

FOREIGN PATENT DOCUMENTS

GB 2309241 A 7/1997

OTHER PUBLICATIONS

Bolding, Jeff L., et al., "Resurrecting a Low-Pressure Gas Well Offshore: Through-Tubing Foamer Injection via a Capillary Tubing System and a Specialized WRSCSSV", SPE 110086, Nov. 2007, 1-11.

(Continued)

*Primary Examiner* — Kenneth Thompson
*Assistant Examiner* — Sean Andrish
(74) *Attorney, Agent, or Firm* — Steve Rosenblatt

(57) ABSTRACT

A sensor and transmitter is employed with a pressurized chamber of a downhole tool to be able to tell at a glance when the tool is delivered for service that it is properly charged. The sensor and transmitter can be integrated within the tool so as to be protected from damage during run in. While in service the sensor and transmitter can monitor pressure in real time and include a capability to send surface signals for real time monitoring of chamber pressures corrected for the service depth, temperature and density of the hydraulic fluid, for example. The signal can be acoustic through the control line or the annulus or delivered through a fiber optic cable or signal wire run in the hydraulic control line, an auxiliary line or through the annulus.

8 Claims, 1 Drawing Sheet

U.S. PATENT DOCUMENTS

2006/0076149 A1 4/2006 McCalvina

OTHER PUBLICATIONS

Going, W.S., et al., "Safetuy Valve Technology fo rteh 1990's", SPE 18393, Oct. 1988, 8 pages.

Abou-Sayed, Omar, et al., "Development of a Through-Flow-Line (TFL)-Developed Insert Surface-Controlled Subsurface Safety Valve", SPE 62956, Oct. 2000, 1-11.

Bussear, Terry, et al., "Design and Qualification of a Remotely-Operated, Downhole Flow Control System for High-Rate Water Injection in Deepwater", SPE 88563, Oct. 2004, 1-8 .

* cited by examiner

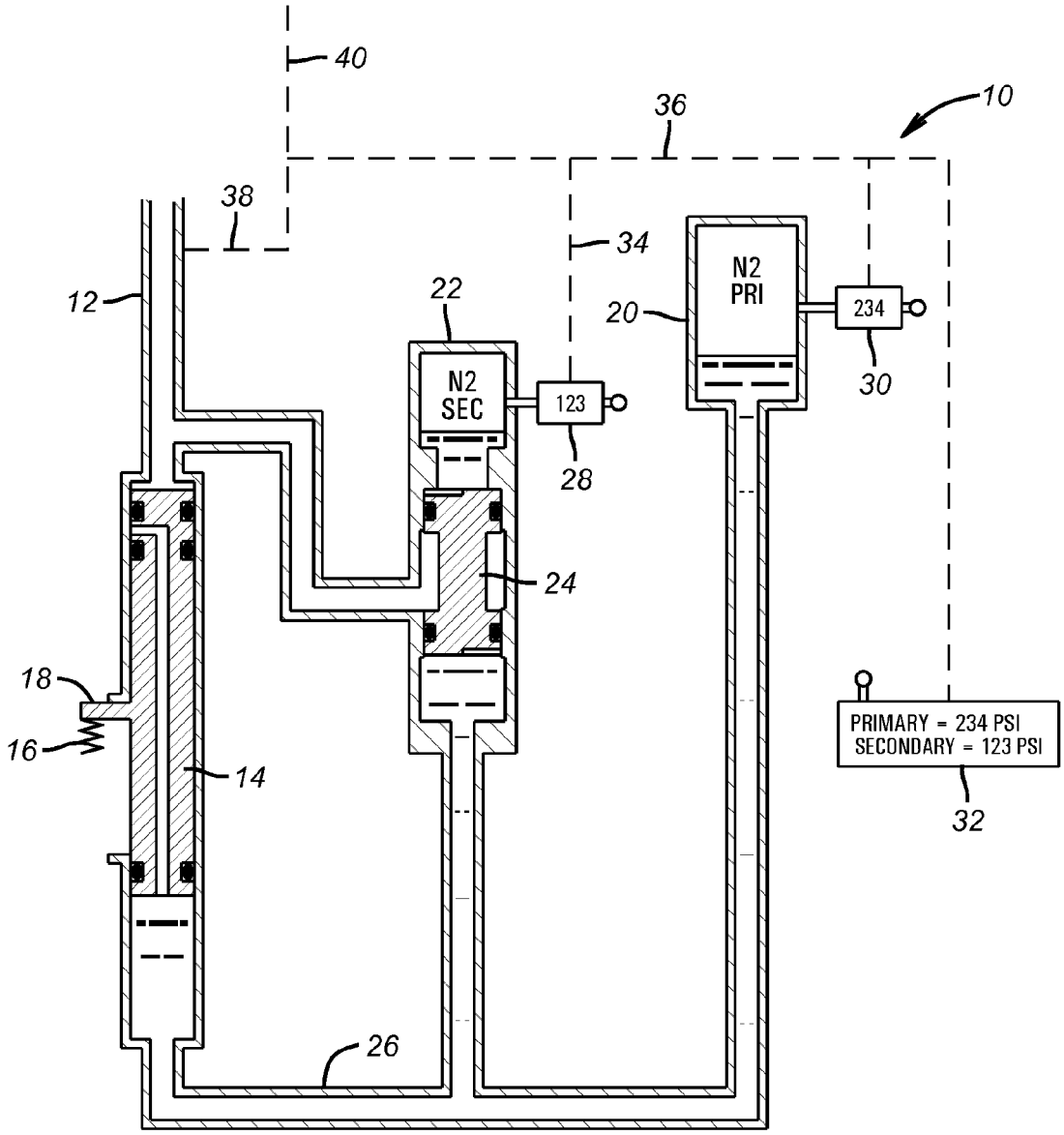
40
36
10
38
34
12
22
N2
PRI
20
234
30
N2
SEC
123
28
24
18
16
14
PRIMARY = 234 PSI
SECONDARY = 123 PSI
32
26

METHOD OF USING A CHARGED CHAMBER PRESSURE TRANSMITTER FOR SUBTERRANEAN TOOLS

RELATED CASE DATA

This application is a continuation of U.S. application Ser. No. 11/642,426 filed Dec. 20, 2006.

FIELD OF THE INVENTION

The field of the invention is a pressure sensing and transmitting device that can be used for downhole tools that have pressure charged chambers to confirm an adequate charge before placing them in service or while in service.

BACKGROUND OF THE INVENTION

There are downhole tools that have integrated pressurized gas chambers that are generally used to offset hydrostatic pressure from a fluid column in a control line that extends from the surface to thousands of meters into the wellbore. Such chambers are illustrated in a subsurface safety valve (SSSV) in U.S. Pat. No. 6,109,351. These downhole tools, when assembled for service are charged with pressure and can sometimes sit in storage for extended periods of time before being deployed downhole. Due to the passage of time from initial charging to actual use, there is uncertainty as to whether the charge is actually still in the chamber or concern that it might not have been charged at all upon assembly. Due to the nature of the service of such tools, they do not feature external gauges to indicate internal pressure because of the risk that such devices may break off during run in. As a result, the tools need to be picked up and mounted in a test fixture and function tested to determine that the gas chamber or chambers are properly charged with the required pressure.

Once the tool is in the hole, there again has been no way to determine if the pressure in the chambers is being retained or if it is slowly dissipating or gone. There are times when a SSSV closes and refuses to open downhole, leaving doubt as to what among several causes could be the reason for such an event.

Accordingly, it is advantageous to know whether there is a charge in a gas chamber of a downhole tool before it goes into service and after it is in service as a diagnostic tool for a malfunction or an early warning tool of an eventual failure. The present invention addresses this need and one application of the invention in a SSSV is described in the description of the preferred embodiment and associated drawing. Those skilled in the art will appreciate that the full scope of the invention is determined by the claims attached to the application.

SUMMARY OF THE INVENTION

A sensor and transmitter is employed with a pressurized chamber of a downhole tool to be able to tell at a glance when the tool is delivered for service that it is properly charged. The sensor and transmitter can be integrated within the tool so as to be protected from damage during run in. While in service the sensor and transmitter can monitor pressure in real time and include a capability to send surface signals for real time monitoring of chamber pressures corrected for the service depth, temperature and density of the hydraulic fluid, for example. The signal can be acoustic through the control line or the annulus or delivered through a fiber optic cable or signal wire run in the hydraulic control line, an auxiliary line or through the annulus.

BRIEF DESCRIPTION OF THE DRAWING

FIG. 1 is an illustration of a control system for a SSSV showing schematically how signals can be sent to the surface in real time to monitor gas charge pressure in the tool.

DETAILED DESCRIPTION OF THE PREFERRED EMBODIMENT

FIG. 1 illustrates a control system for a SSSV that is described in detail as to its operation in U.S. Pat. No. 6,109,351. The actual working of the control system 10 is known and is not a part of the described invention. It is shown as one potential application of the invention to a downhole tool while recognizing that other tools that have fluid pressurized chambers as an integral component can also benefit from the invention.

This illustrated control system for a SSSV has a control line 12 that extends from the surface to the tool body. In normal operation, raising the pressure in line 12 shifts a piston 14 against a spring 16 so that a tab 18 drives a flow tube (not shown) that in turn rotates a flapper (also not shown) to hold the SSSV open. Chamber 20 is preferably charged with nitrogen and the pressure in it offsets the hydrostatic pressure from fluid in the control line 12 from the surface down to piston 14. Chamber 22 acts on an equalizer piston 24 which can selectively put piston 14 in pressure balance by communicating control line 12 to the underside of piston 14 through passage 26 when certain seals in the system fail or if the charge pressure in chamber 20 is reduced or disappears due to leakage.

As also shown in FIG. 1 each chamber 20 and 22 is fitted with a pressure sensor and transmitter 28 and 30. This equipment can be within the tool housing. On the surface, the equipment can transmit to a local receiver 32 to get a temperature corrected reading so that comparisons can be made to the pressure and air temperature when the initial charging took place. In this manner, without having to move the SSSV, its state of charge in reservoirs 20 and 22 can be readily determined. Downhole, sensor transmitters 28 and 30 can be equipped to provide a real time signal to the surface of the pressure corrected for well conditions and the density of the hydraulic fluid column in line 12 in a variety of ways. These transmissions are illustrated schematically with dashed lines 34 and 36 that in turn can lead to the annulus through line 40 and through the control line through line 38. The signals can take various forms. For example, the signal can be acoustic and be sent up the annulus schematically shown as 40 or the control line 12 shown as 38. Alternatively, a separate control line can be run parallel to control line 12 and signals to the surface can go up by wire, fiber optic cable, acoustic or other signal mode. Alternatively wire or cable can simply be run exposed in the annulus without the protection of a rigid conduit. Surface equipment can interpret the signal and display and store the real time readings. Alternatively, readings can be taken over predetermined intervals rather than in real time to prolong service life of the power source, such as a battery. Alternatively, power can be supplied from the surface to the sensor transmitters so as to allow a service life that can match the time the SSSV is likely to be in service in the wellbore. The sensor transmitters can be integral or separate devices and a single transmitter can be used with multiple sensors and send discrete signals so that at the surface it will be clear which portion of the tool is being sensed for pressure, or for that matter any other tool condition at any given time.

With this system in place, a slow leak in chambers 20 or 22 can be detected to allow a planned shutdown to take place to remove the SSSV for repair.

In the case of receiver 32 the original charging pressure and temperature can be stored in it as well as a processor that corrects any subsequent reading back to the baseline temperature of the original pressurization.

The above description is illustrative of the preferred embodiment and many modifications may be made by those skilled in the art without departing from the invention whose scope is to be determined from the literal and equivalent scope of the claims below:

We claim:

1. A method of using a control system for a downhole tool comprising:

providing the downhole tool;

initially charging at least one reservoir in said tool with a predetermined pressure;

then, storing said tool at the surface for a period of time such that a level of the initial charge is uncertain;

after said storing, providing a way to later confirm remaining positive pressure in the reservoir, without moving said tool, using a sensor on said at least one reservoir;

transmitting said sensed positive internal pressure to outside said reservoir to a receiver;

running said tool into a wellbore;

sensing the reservoir pressure when said tool is located downhole;

communicating the sensed pressure to the surface;

operating said tool using the pressure in said reservoir.

2. The method of claim 1, comprising:

providing a processor in said receiver to correct for temperature changes from the time of originally charging the reservoir to a temperature at a pressure reading taken before running said tool into the wellbore.

3. The method of claim 1, comprising:

transmitting said sensed positive internal pressure over the air to said receiver.

4. The method of claim 1, comprising:

sending one of an acoustic, pressure pulse, electrical and a light signal to the surface from said tool.

5. The method of claim 4, comprising:

sending one of a real time and an intermittent signal to the surface.

6. The method of claim 5, comprising:

sending the signal through one of an annulus and a control line from the tool to the surface.

7. The method of claim 6, comprising:

running a fiber optic or electrical line from the tool to the surface.

8. The method of claim 5, comprising:

correcting the sent pressure signal to account for well or control line conditions at said tool.

* * * * *